US010864615B2

(12) United States Patent
Ceniza

(10) Patent No.: US 10,864,615 B2
(45) Date of Patent: Dec. 15, 2020

(54) SPLIT VISE

(71) Applicant: Toyota Motor Engineering & Manufacturing North America, Inc., Plano, TX (US)

(72) Inventor: Rommel B. Ceniza, Guelph (CA)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 119 days.

(21) Appl. No.: 16/227,000

(22) Filed: Dec. 20, 2018

(65) Prior Publication Data

US 2020/0198098 A1 Jun. 25, 2020

(51) Int. Cl.
*B25B 1/00* (2006.01)
*B25B 1/02* (2006.01)
*B25B 1/10* (2006.01)

(52) U.S. Cl.
CPC . *B25B 1/02* (2013.01); *B25B 1/10* (2013.01)

(58) Field of Classification Search
CPC .... B25B 1/02; B25B 1/20; B25B 5/00; B25B 5/067; B25B 5/101
See application file for complete search history.

(56) References Cited

U.S. PATENT DOCUMENTS 3,866,897 A 2/1975 Whalen
4,601,221 A * 7/1986 Kalkbrenner ..... B25B 7/123 269/258
4,613,120 A 9/1986 Kozar
4,673,174 A * 6/1987 Tabbert ..... B25B 5/04 269/228
4,747,588 A * 5/1988 Dillhoff ..... B25B 5/12 269/258
D333,771 S * 3/1993 Aoki ..... D8/72
5,953,802 A * 9/1999 Radzio ..... B25B 27/00 254/100
6,930,272 B1 8/2005 Limano
7,104,166 B1 * 9/2006 Wong ..... B25B 5/12 81/180.1

(Continued)

OTHER PUBLICATIONS

Tutsky, R., "A Handy Bench Top Low Profile Vise for Band Saw or Drill Press Use," (http://www.benchtopwoodworkingtools.com/handy-benchtop-vise_for_bandsaw-drill-press/) Jun. 8, 2013.

(Continued)

*Primary Examiner* — Lee D Wilson
(74) *Attorney, Agent, or Firm* — Christopher G. Darrow; Darrow Mustafa PC

(57) ABSTRACT

Embodiments described herein relate to a vise, for example, for holding material to be cut with a saw, for example, power saw. In one embodiment the disclosed vise includes a base member, a pair of fixed jaws attached to a first side of the base member, the pair of fixed jaws being substantially aligned and spaced apart defining a first gap therebetween, a handle attached to a second side of the base opposite the first side, and a pair of moveable jaws adjustably connected to the pair of fixed jaws, the pair of moveable jaws being spaced apart defining a second gap therebetween, wherein a center of the second gap is substantially aligned with a center of the first gap.

6 Claims, 3 Drawing Sheets

(56) References Cited

U.S. PATENT DOCUMENTS 7,226,047 B1 * 6/2007 Beauchamp ..... B23K 37/0533
269/43

OTHER PUBLICATIONS

"Moxon Vise," by Lake Erie Toolworks (https://www.woodcraft.com/products/moxon-vise).
"Accu-Slot®" by Accu-Slice (http://www.accu-slice.com/store/p24/accu-slot.html).

* cited by examiner

SPLIT VISE

TECHNICAL FIELD

The subject matter described herein relates to a type of vise for holding material that is being cut with a saw, for example, a band saw.

BACKGROUND

Working with saws, particularly power saws, carries an inherent risk of injury. The risk is increased when cutting a workpiece that is relatively small. For example, on a band saw a user manually slides the material across the band saw table directly into the moving blade, maneuvering the workpiece according to the desired direction of the cut to obtain the desired shape. Such maneuvers can result in the user's hand being pushed dangerously close to the moving blade.

SUMMARY

Embodiments described herein are associated with devices that can hold material that is to be cut with a saw, e.g., a power saw such as a band saw.

Therefore, a vise is disclosed. For example, in one embodiment, the disclosed vise includes a base member, a pair of fixed jaws, a pair of moveable jaws, and a handle. The pair of fixed jaws are attached to a first side of the base member and spaced apart defining a first gap therebetween. The handle attached to a second side of the base opposite the first side. The pair of moveable jaws are adjustably connected to the pair of fixed jaws and spaced apart defining a second gap therebetween. A center of the second gap is substantially aligned with a center of the first gap.

BRIEF DESCRIPTION OF THE DRAWINGS

The accompanying drawings, which are incorporated in and constitute a part of the specification, illustrate various embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

This detailed description relates to vises for holding material to be cut with a saw. Detailed embodiments are disclosed herein, however, it is to be understood that the disclosed embodiments are intended only as examples. Specific structural and functional details disclosed herein are not to be interpreted as limiting, but merely as a basis for the claims and as a representative basis for teaching one skilled in the art to variously employ the features described herein in virtually any appropriately detailed structure. Further, the terms and phrases used herein are not intended to be limiting but rather to provide an understandable description of possible implementations.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Power saws, such as band saws, rope saws, or circular saws, are commonly used to cut various materials (such as wood or metal) with a blade that moves continuously while the material is pressed into the blade and maneuvered to achieve the desired cut. The material is often guided by hand in order to achieve intricate cuts, however, this practice can result in a user's hands being pushed dangerously close to the blade, which can lead to serious injury.

Figure 1:
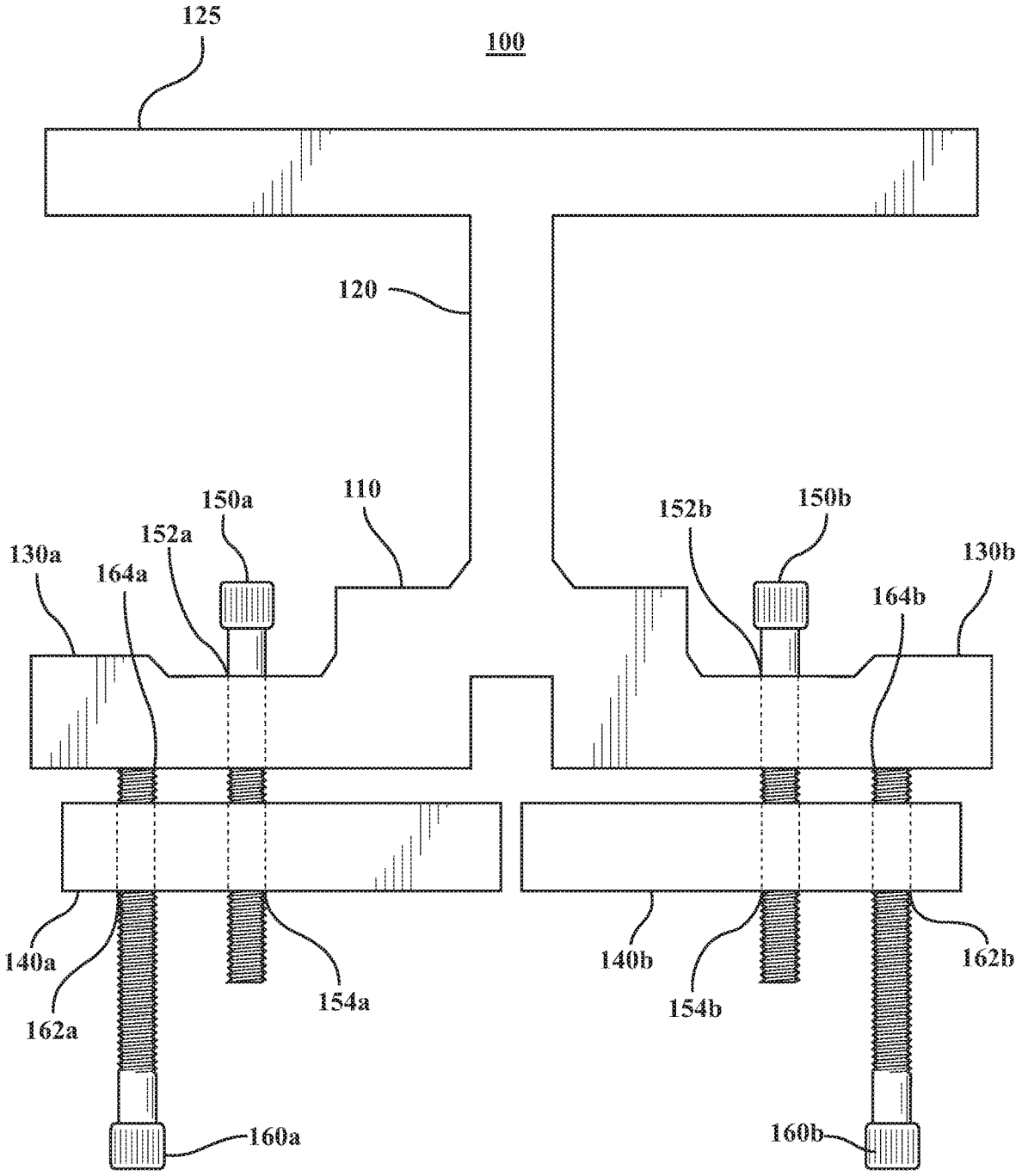
FIG. 1 illustrates a perspective view of an embodiment of a vise according to the disclosed subject matter.
Figure 2:
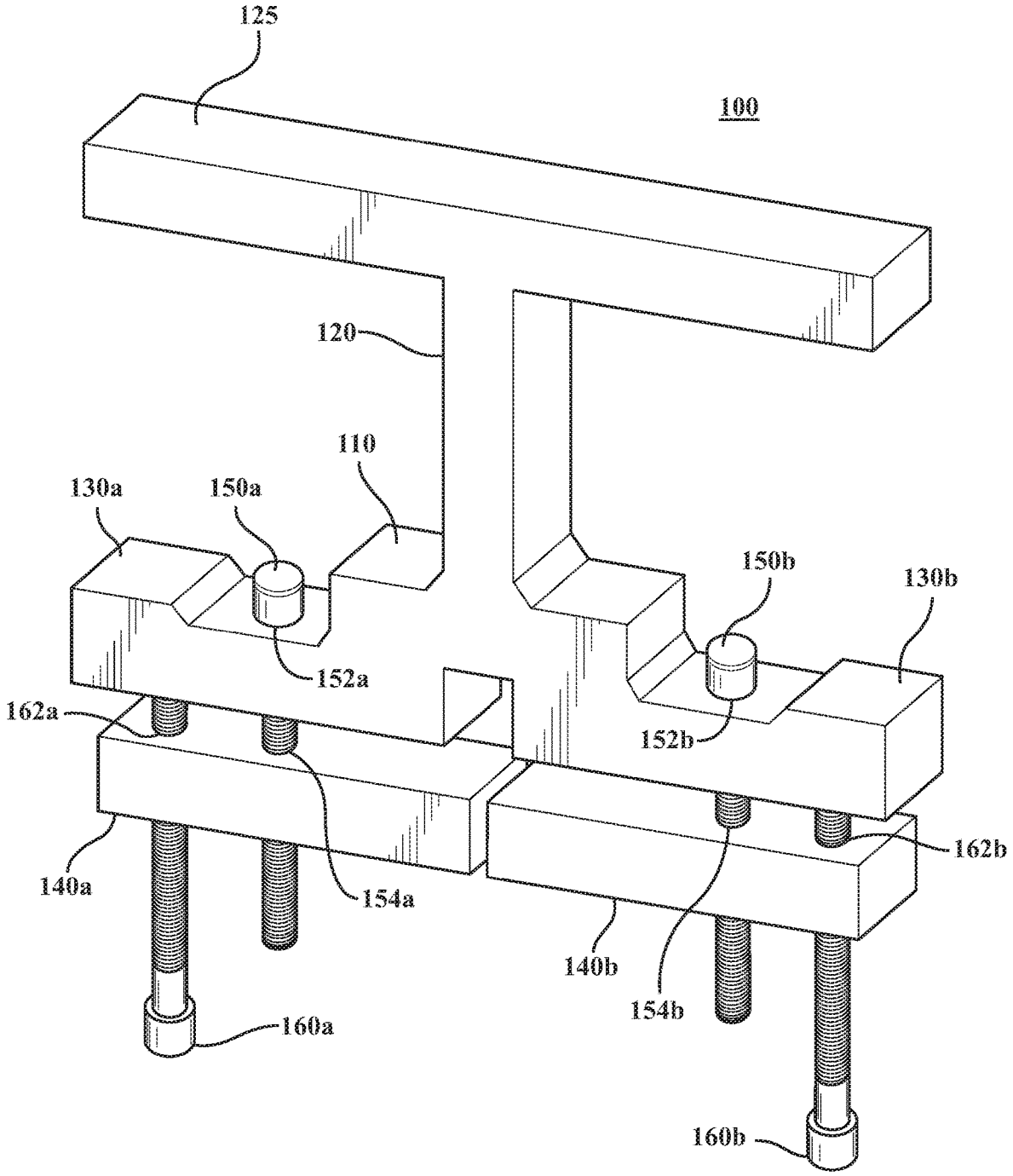
FIG. 2 illustrates a top view of an embodiment of a vise according to the disclosed subject matter.
Figure 3:
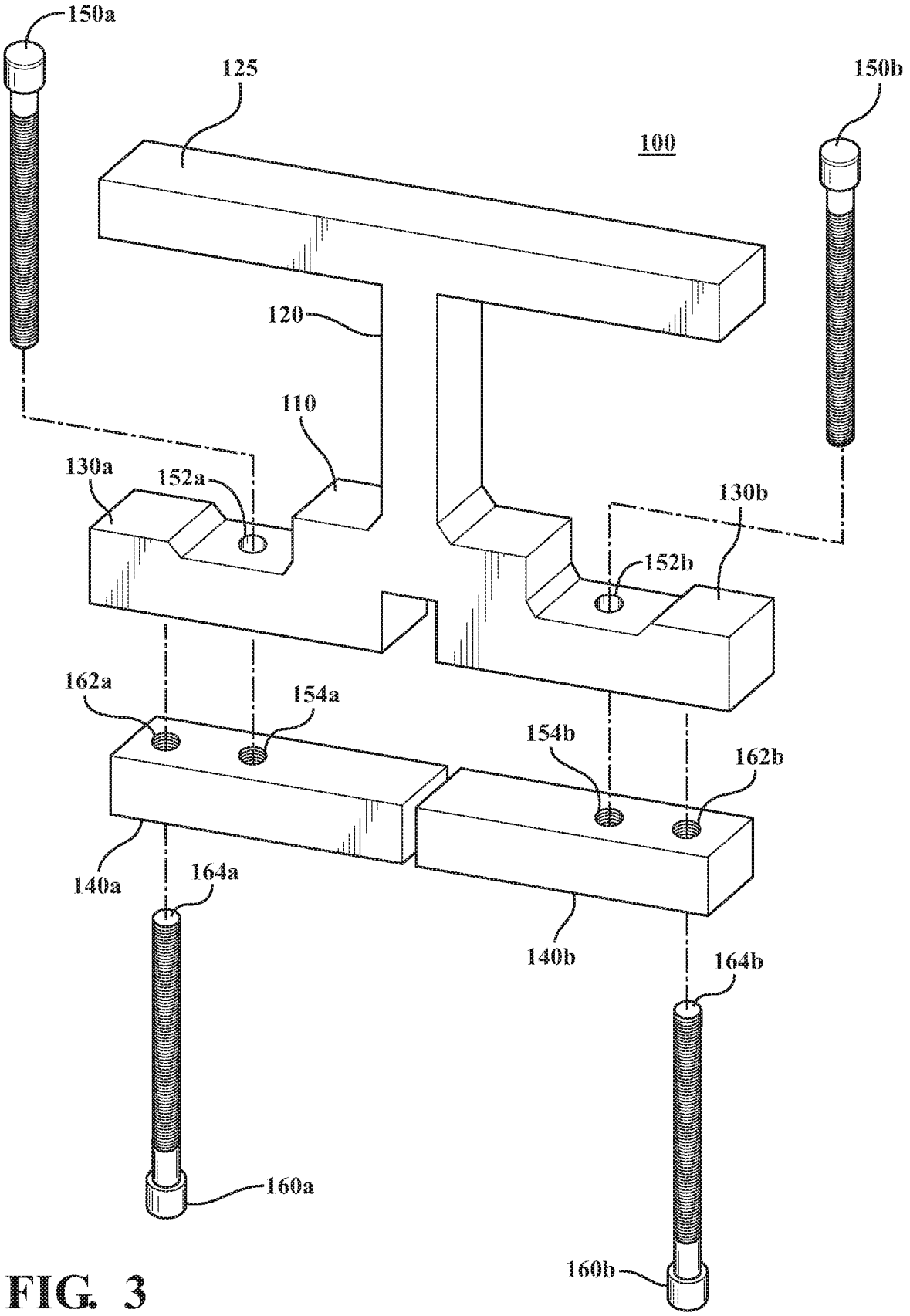
FIG. 3 illustrates an exploded view of an embodiment of a vise according to the disclosed subject matter.

FIGS. 1-3 show an embodiment of a vise according to the disclosed subject matter that can mitigate against injury to a user working with a power saw. The vise 100 can be constructed of any suitable, such as metal or wood. The vise 100 includes a base 110 having a handle 110 attached on one side and fixed jaws 130*a*, 130*b* attached on the side opposite the handle 110. In one embodiment the base 110 is substantially rectangular in shape.

The handle 120 can be substantially rectangular or substantially cylindrical in shape, but it will be understood that other shapes are possible. The handle 120 can include a crossbar member 125 to provide increased gripping options for a user to control the vise 100. That is, the handle 120 can include an elongated member 120 attached to the base 110 and a crossbar member 125 attached to the elongated member 120.

The base 110, handle 110, and fixed jaws 130*a*, 130*b* can be made using any suitable process, including, for example, stamping, bending, and/or cutting. In one or more embodiments the base 110, handle 110, and fixed jaws 130*a*, 130*b* can be formed as a single piece. In one or more embodiments the base 110, handle 110, and fixed jaws 130*a*, 130*b* can be made of a plurality of separate pieces. The plurality of separate pieces can be joined together in any suitable manner, including, for example, welding, brazing, and/or one or more fasteners.

The fixed jaws 130*a*, 130*b* can be substantially rectangular but it will be understood that other shapes are possible, including, for example, substantially triangular, substantially polygonal or irregular. In one embodiment the fixed jaws 130*a*, 130*b* are positioned spaced apart, defining a gap between the fixed jaws 130*a*, 130*b* to permit an optional entry point for a saw blade having passed through a workpiece held by the vise 100, for example, when a user intends to severe a workpiece completely.

The fixed jaws 130*a*, 130*b* are connected to moveable jaws 140*a*, 140*b* by bolts 150*a*, 150*b* and 160*a*, 160*b*. More specifically, moveable jaw 140*a* is connected to fixed jaw 130*a* by bolts 150*a* and 160*a* while moveable jaw 140*b* is connected to fixed jaw 130*b* by bolts 150*b* and 160*b*. That is, each member of the pair of moveable jaws 140*a*, 140*b* is connected to a respective member of the pair of fixed jaws 130*a*, 130*b* by at least a pair of bolts 150*a*, 150*b* and 160*a*, 160*b*.

The moveable jaws 140*a*, 140*b* can be substantially rectangular but it will be understood that other shapes are possible, including, for example, substantially triangular, substantially polygonal or irregular. The moveable jaws 140*a*, 140*b* are positioned such that a gap is defined between the moveable jaws 140*a*, 140*b* to provide an entry point for a saw blade to cut a workpiece held by the vise 100. In one embodiment the gap between moveable jaws 140*a*, 140*b* is smaller than the gap between fixed jaws 130*a*, 130*b*.

In one embodiment, bolt 150*a* passes through a non-threaded through-hole 152*a* in fixed jaw 130*a* and through a threaded through-hole 154*a* in moveable jaw 140*a*. In this configuration the distance between the moveable jaw 140*a* and the fixed jaw 130*a* can be controlled by adjusting the bolt 150*a*. For example, in one embodiment turning the bolt 150*a* in clockwise direction pulls the moveable jaw 140*a* closer to the fixed jaw 130*a* while turning the bolt 150*a* in a counter-clockwise direction pushes the moveable jaw 140*a* farther away from the fixed jaw 130*a*. Bolt 160*a* passes through a non-threaded through-hole 162*a* in moveable jaw 140*a* and enters a threaded hole 164*a* in fixed jaw 130*a*. In this configuration bolt 160*a* stabilizes moveable jaw 140*a*. A similar or identical operational relationship exists between fixed jaw 130*b*, moveable jaw 140*b*, bolts 150*b*, 160*b*, and holes 152*b*, 154*b*, 162*b*, 164*b*.

In operation a user places a workpiece between moveable jaws 140*a*, 140*b* and fixed jaws 130*a*, 130*b*, aligning a section of the workpiece that is intended to be cut with the gap defined between the moveable jaws 140*a*, 140*b*. The user then tightens the moveable jaws 140*a*, 140*b* against the fixed jaws 130*a*, 130*b* to secure the workpiece in place. Each of moveable jaws 140*a*, 140*b* can be independently adjusted. Thus, the user can secure an irregular shaped workpiece in the vise 100.

With the workpiece secured, the user can grip the handle 120 of the vice 100 and use it to guide the workpiece into the saw (e.g., a band saw) to be cut. If the user desires to completely sever the workpiece, the user can guide workpiece such that the saw blade passes completely through the workpiece and into the gap between the fixed jaws 130*a*, 130*b*. If the user instead desires to make a series of intricate cuts, the user can reverse the direction of movement and maneuver the workpiece away from the saw blade. Once the workpiece is removed from the saw blade the user can adjust the position of the workpiece in the vise 100 as required to make any subsequent cuts Accordingly, the vise 100 provides the user with various benefits. The user can achieve a high degree of control to execute turns, for example, to create sharp angle cuts or follow complex patterns on a relatively small workpiece, without the risk of the user placing a hand in a dangerous position near the saw blade to maintain control of the workpiece. The user can furthermore execute precision cuts on irregular shaped workpieces.

Aspects herein can be embodied in other forms without departing from the spirit or essential attributes thereof. Accordingly, reference should be made to the following claims, rather than to the foregoing specification, as indicating the scope hereof.

What is claimed is:

1. A vise, comprising:

a base member;

a pair of fixed jaws attached to a first side of the base member, the pair of fixed jaws being substantially aligned and spaced apart defining a first gap therebetween;

a handle attached to a second side of the base opposite the first side; and a pair of moveable jaws adjustably connected to the pair of fixed jaws, the pair of moveable jaws being spaced apart defining a second gap therebetween, wherein a center of the second gap is substantially aligned with a center of the first gap, and wherein each member of the pair of moveable jaws is connected to a respective member of the pair of fixed jaws by a pair of bolts, each pair of bolts comprising a first bolt and a second bolt, the first bolt being inserted through a first hole in the fixed jaws and passing through a first hole in the moveable jaws, and the second bolt being inserted through a second hole in the moveable jaws and entering a second hole in the fixed jaws.

2. The vise of claim 1, wherein the handle comprises an elongated member attached to the base member and a crossbar member attached to the elongated member.

3. The vise of claim 1, wherein the first hole in the fixed jaws is non-threaded, the first hole in the moveable jaws is threaded, the second hole in the fixed jaws is threaded, and the second hole in the moveable jaws is non-threaded.

4. The vise of claim 1, wherein the first gap is wider than the second gap.

5. The vise of claim 1, wherein the base member, moveable jaws and fixed jaws are each constructed of metal.

6. A vise, comprising:

a base member;

a pair of fixed jaws attached to a first side of the base member, the pair of fixed jaws being substantially aligned and spaced apart defining a first gap therebetween;

a handle attached to a second side of the base opposite the first side; and a pair of moveable jaws adjustably connected to the pair of fixed jaws, the pair of moveable jaws being spaced apart defining a second gap therebetween, wherein a center of the second gap is substantially aligned with a center of the first gap, and wherein the base member, fixed jaws, and handle, are formed of a single piece.

* * * * *